US007982381B2

(12) United States Patent
Suzuki

(10) Patent No.: US 7,982,381 B2
(45) Date of Patent: Jul. 19, 2011

(54) ELECTRON SOURCE AND IMAGE DISPLAY APPARATUS

(75) Inventor: Nobumasa Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 67 days.

(21) Appl. No.: 12/421,365

(22) Filed: Apr. 9, 2009

(65) Prior Publication Data

US 2009/0273270 A1 Nov. 5, 2009

(30) Foreign Application Priority Data

May 2, 2008 (JP) ..... 2008-120409

(51) Int. Cl.
*H01J 1/46* (2006.01)

(52) U.S. Cl. ..... 313/308; 313/306; 313/310; 313/497

(58) Field of Classification Search ..... None
See application file for complete search history.

(56) References Cited

U.S. PATENT DOCUMENTS

| | | | | |
|---|---|---|---|---|
| 6,005,333 | A | 12/1999 | Kaneko et al. | 313/306 |
| 6,426,733 | B1 * | 7/2002 | Yamada | 345/74.1 |
| 2004/0213897 | A1 | 10/2004 | Miyamoto et al. | 427/58 |
| 2008/0002079 | A1 * | 1/2008 | Kimura | 349/42 |

FOREIGN PATENT DOCUMENTS

| | | | |
|---|---|---|---|
| EP | 0 354 750 | A2 | 2/1990 |
| EP | 0 388 984 | A2 | 9/1990 |

* cited by examiner

*Primary Examiner* — Ashok Patel
(74) *Attorney, Agent, or Firm* — Fitzpatrick, Cella, Harper & Scinto

(57) ABSTRACT

An electron source including: a plurality of electron-emitting devices connected to a matrix wiring of scan lines and modulation lines on a substrate, wherein each of the electron-emitting devices includes a cathode electrode connected to the scan line, a gate electrode connected to the modulation line and a plurality of electron-emitting members, the cathode electrode is configured in a first comb-like structure for applying an electric potential of the cathode to the plurality of electron-emitting members, the gate electrode is configured in a second comb-like structure for applying an electric potential of the gate to the plurality of electron-emitting members, and each of the first and second comb-like structures is provided with a plurality of comb-teeth, and a connecting electrode electrically connected to the plurality of teeth in at least one of the first and second comb-like structures.

8 Claims, 13 Drawing Sheets

ELECTRON SOURCE AND IMAGE DISPLAY APPARATUS

BACKGROUND OF THE INVENTION

1. Field of the Invention

The present invention relates to an electron source, and an image display apparatus having the electron source.

2. Description of the Related Art

In European patent No. 0354750, an electron-emitting device is known in which a cold cathode and a gate electrode are formed so as to have a comb-like shape, and are formed so that the comb-like shapes are engaged with each other.

An image display apparatus having such an electron-emitting device makes the electron-emitting device emit an electron, makes an anode electrode to which a high voltage is applied accelerate the electron, makes the electron collide against a phosphor, and makes the phosphor emit light. The electron-emitting devices are connected to a matrix wiring of scan lines and modulation lines, and a plurality of the electron-emitting devices emit electrons to make an image display apparatus display the image.

SUMMARY OF THE INVENTION

The inner part of an image display apparatus having an electron-emitting device is generally kept at a high vacuum. As was described above, a high voltage is applied to the anode electrode. For this reason, lines such as a scan line and a signal line and the electron-emitting device are exposed to a high electric field. Accordingly, when triple points and foreign materials on which an electric field easily converges exist in the electron-emitting device or the lines, the electric field converges on the points and foreign materials, which occasionally causes electric discharge in a vacuum in the inner part of the image display apparatus.

When the electric discharge has occurred, an electric charge which has been accumulated in the anode electrode flows into the electron-emitting device and the lines, and an electric current occasionally flows into even a driving circuit which has been connected with the lines. As a result, the electric current can occasionally destroy the driving circuit.

In addition, when a large electric current flows into the lines such as the scan line and the signal line and increases a potential of the wiring, an excessive voltage is consequently applied to the electron-emitting device which has been connected to those lines. As a result, the excessive voltage destroys the plurality of the electron-emitting devices which are connected to one line, and occasionally can cause a defect of pixel continuity.

The present invention is directed at providing an electron source and an image display apparatus which can inhibit the destruction of an electron-emitting device due to the electric discharge.

An electron source or an image display apparatus according to the present invention is or includes, an electron source including: a plurality of electron-emitting devices connected to a matrix wiring of scan lines and modulation lines on a substrate, wherein each of the electron-emitting devices includes a cathode electrode connected to the scan line, a gate electrode connected to the modulation line and a plurality of electron-emitting members, the cathode electrode is configured in a first comb-like structure for applying an electric potential of the cathode to the plurality of the electron-emitting members, the gate electrode is configured in a second comb-like structure for applying an electric potential of the gate to the plurality of electron-emitting members, and each of the first and second comb-like structures is provided with a plurality of comb-teeth, and a connecting electrode electrically connected to the plurality of teeth in at least one of the first and second comb-like structures.

The electron-emitting device according to the present invention means a device which constitutes one sub-pixel in the case of being used as an image display apparatus. The electron-emitting device according to the present invention includes a plurality of electron-emitting members. The electron-emitting member emits an electron when an electric potential of the cathode is applied to a cathode electrode and an electric potential of the gate is applied to a gate electrode. An electron source according to the present invention includes a plurality of electron-emitting devices which are connected to a matrix wiring of scan lines and a modulation lines.

Such a constitution according to the present invention can inhibit the destruction of the electron-emitting device due to electric discharge.

Further features of the present invention will become apparent from the following description of exemplary embodiments with reference to the attached drawings.

DESCRIPTION OF THE EMBODIMENTS

Embodiments according to the present invention will now be described below with reference to the drawings.

First Embodiment (Configuration of Image Display Apparatus)

An image display apparatus according to the present invention having an electron source provided with a plurality of electron-emitting devices will now be described with reference to FIG. 1 and FIG. 2.

Figure 1:
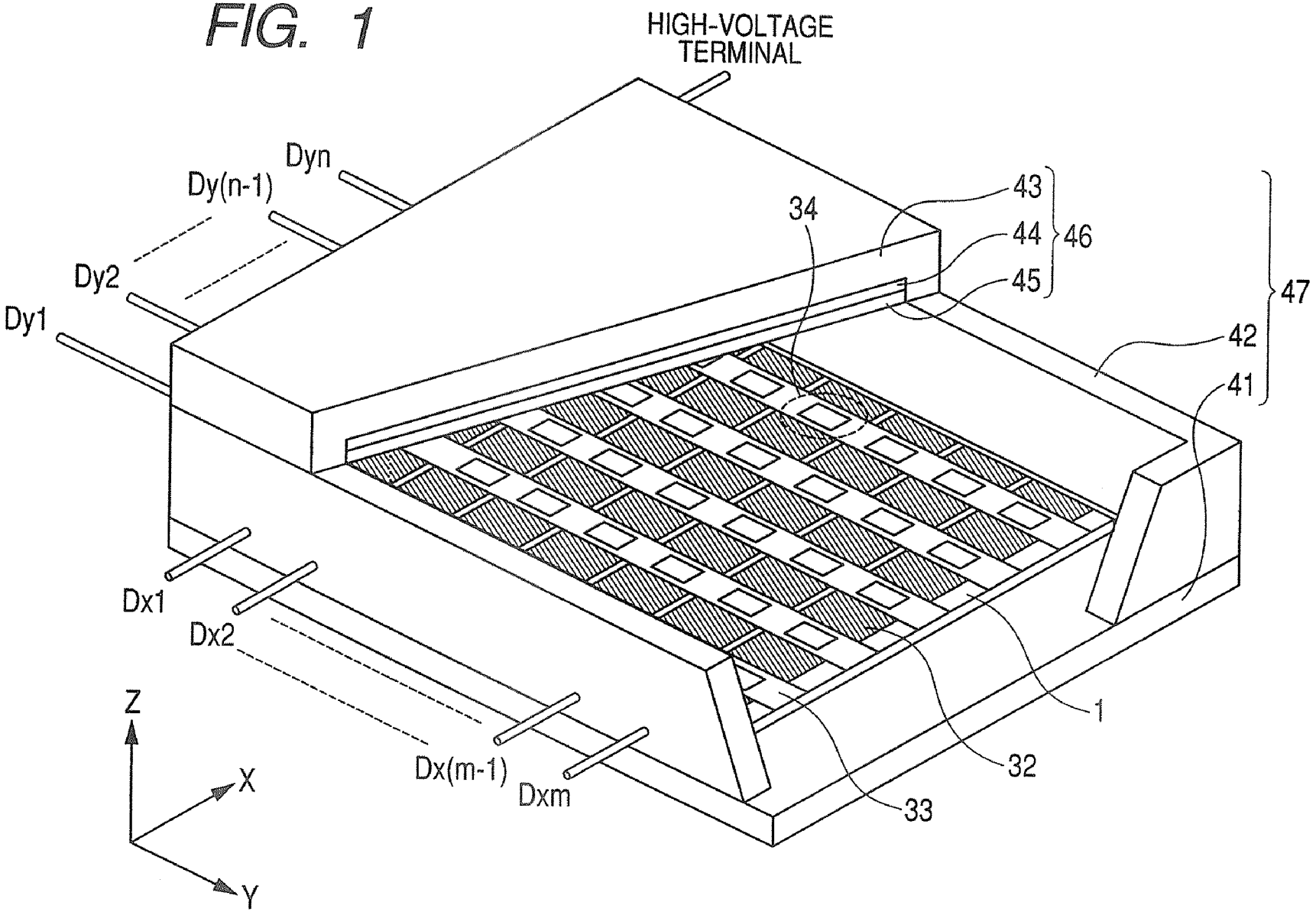
FIG. 1 is a perspective view illustrating one example of a structure of an image display apparatus according to the present invention.

FIG. 1 is a perspective view illustrating one example of a configuration of the image display apparatus according to the present invention, in which one part of the apparatus is cut away for illustrating the inner structure. In the figure, a substrate 1, a scan line 32, a modulation line 33 and an electron-emitting device 34 are shown. A rear plate 41 fixes a substrate 1 thereon, and a face plate 46 has a phosphor 44, and a metal back 45 which works as an anode electrode, which are formed on the inner face of a glass substrate 43. An envelope 47 is constituted by a supporting frame 42, and by the rear plate 41 and the face plate 46, which are attached to the supporting frame 42 through frit glass. Here, the rear plate 41 is provided mainly for the purpose of reinforcing the strength of the substrate 1, so that when the substrate 1 itself has a sufficient strength, an additional rear plate 41 is unnecessary. The image display apparatus also can have a configuration in which an unshown support member referred to as a spacer is installed in between the face plate 46 and the rear plate 41 to impart a sufficient strength against atmospheric pressure to the apparatus.

M lines of scan lines 32 are connected to terminals Dx1 and Dx2 to Dxm; and n lines of modulation lines 33 are connected to terminals Dy1 and Dy2 to Dyn (where m and n are both positive integer number). An unshown interlayer insulating layer is provided in between m lines of the scan lines 32 and n lines of the modulation lines 33, and electrically separates the both lines from each other.

A high-voltage terminal is connected to the metal back 45, and supplies a DC voltage, for instance, of 10 [kv] to the metal back 45 therethrough. The DC voltage is an accelerating voltage for imparting sufficient energy for exciting the phosphor to an electron beam to be emitted from the electron-emitting device.

Figure 2:
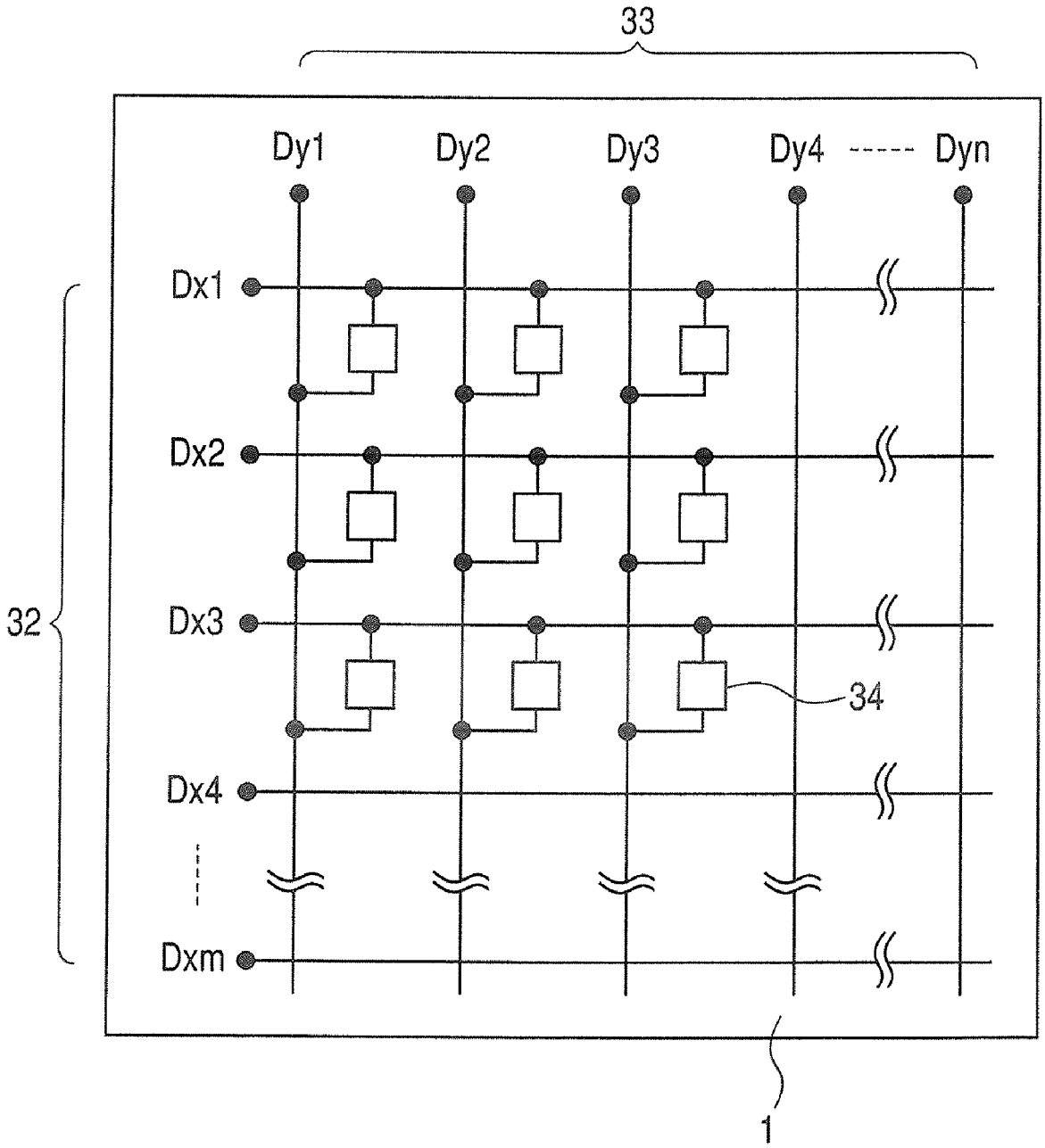
FIG. 2 is a schematic view illustrating an electron source according to the present invention.

FIG. 2 is a schematic view illustrating an electron source according to the present invention. The electron source according to the present invention has a plurality of electron-emitting devices 34 which are connected to a matrix wiring of the scan lines 32 and the modulation lines 33.

A scan circuit (unshown) is connected to the scan lines 32, and applies a scanning signal for selecting a row of electron-emitting devices 34 which have been arrayed in an X-direction, to the lines. On the other hand, a modulation circuit (unshown) is connected to the modulation lines 33, and modulates each column of the electron-emitting devices 34 which have been arrayed in a Y-direction, according to an input signal. A driving voltage to be applied to each of the electron-emitting devices is supplied in a form of a differential voltage between the scanning signal and the modulation signal to be applied to the electron-emitting device.

(Configuration of Electron-Emitting Device)

Figure 3:
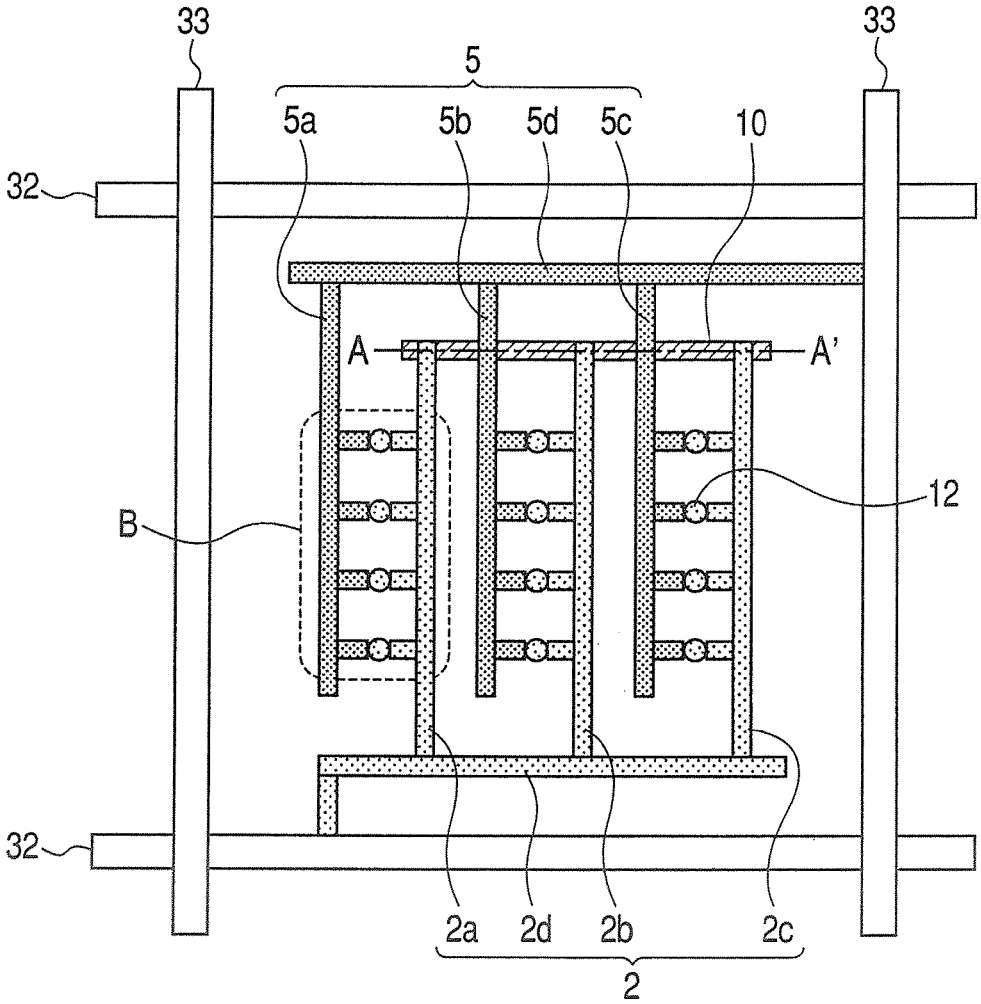
FIG. 3 is a schematic view illustrating an electron-emitting device in a first embodiment.

FIG. 3 is a schematic view illustrating an electron-emitting device according to the present invention.

A cathode electrode 2 is connected to a scan line 32. An electric potential of the cathode is applied to the cathode electrode 2 from the scan line 32. A gate electrode 5 is connected to a modulation line 33. An electric potential of the gate is applied to the gate electrode 5 from the modulation line 33.

An electron-emitting device according to the present invention has a plurality of electron-emitting members 12. Each of the plurality of the electron-emitting members is connected to the cathode electrode 2 and the gate electrode 5. When a scanning signal which has been applied to the scan line 32 is applied to the electron-emitting member 12 through the cathode electrode 2 as an electric potential of the cathode, and a modulation signal which has been applied to the modulation line 33 is applied to the electron-emitting member 12 through the gate electrode 5 as an electric potential of the gate, electrons are emitted from the plurality of the electron-emitting members 12.

As is illustrated in the figure, the cathode electrode 2 according to the present invention has a comb-like structure (corresponding to "first comb-like structure" according to the present invention). Specifically, the comb-like structure of the cathode electrode 2 has at least teeth 2*a*, 2*b* and 2*c*. The comb-like structure of the cathode electrode 2 in the present embodiment also has a handle part 2*d*.

Similarly, the gate electrode 5 according to the present invention has a comb-like structure (corresponding to "second comb-like structure" according to the present invention). Specifically, the comb-like structure of the gate electrode 5 has at least teeth 5*a*, 5*b* and 5*c*. The comb-like structure of the gate electrode 5 in the present embodiment further has a handle part 5*d*.

Furthermore, the electron-emitting device according to the present invention has a connecting electrode 10 which is electrically connected with the plurality of the teeth. The connecting electrode 10 in the present embodiment is electrically connected with the plurality of the teeth 2*a*, 2*b* and 2*c*, which are included in the comb-like structure of the cathode electrode 2.

Figure 4:
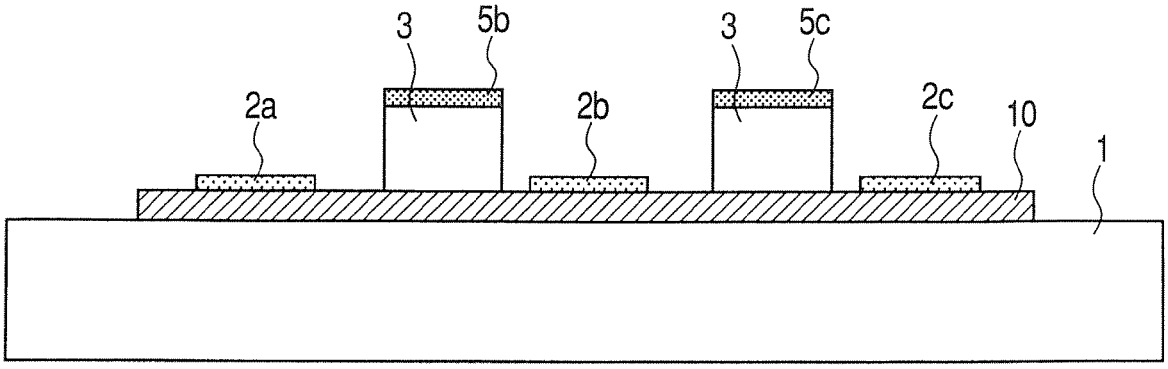
FIG. 4 is a sectional view taken along the line A-A' of FIG. 3.

FIG. 4 illustrates a sectional view taken along the line A-A' of FIG. 3.

In the present embodiment, the connecting electrode 10 is provided on a substrate 1, and the teeth 2*a*, 2*b* and 2*c* of the cathode electrode are provided on the connecting electrode 10. On the other hand, an insulating member 3 is provided in between the connecting electrode 10 and the teeth 5*b* and 5*c* of the gate electrode. Thereby, the connecting electrode 10 is electrically connected only with the cathode electrode 2.

(Configuration of Electron-Emitting Member)

Figure 5A:
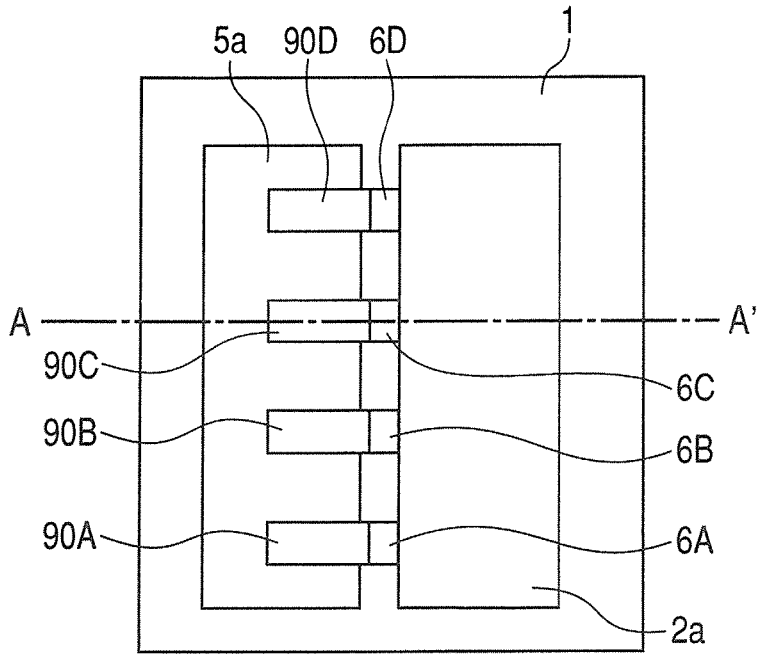
FIGS. 5A, 5B and 5C are views illustrating an electron-emitting member in the first embodiment.
Figure 5B:
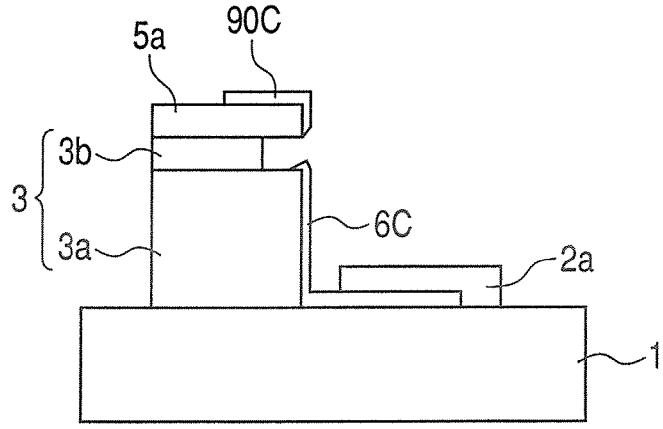
Figure 5C:
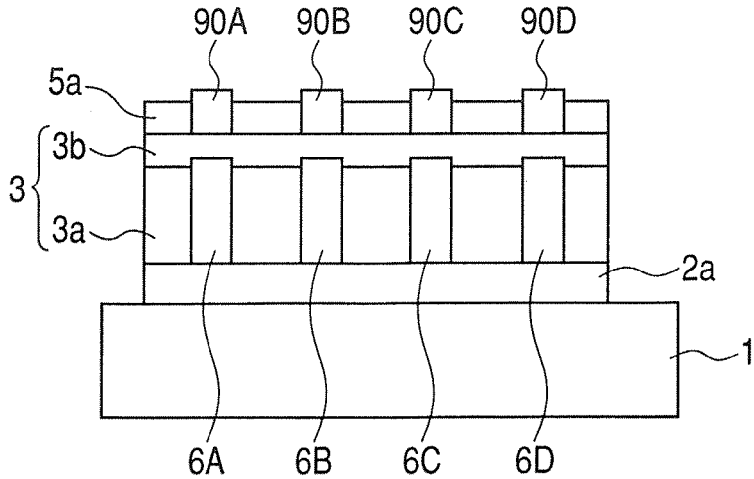

FIGS. 5A, 5B and 5C illustrate a configuration of an electron-emitting member in a portion which is shown by B in FIG. 3. FIG. 5A is a plan view in a portion which is shown by B in FIG. 3. FIG. 5B is a sectional view taken along the line A-A' of FIG. 5A. FIG. 5C is a right side view of FIG. 5A.

As is clear from the figure, in the present embodiment, a plurality of electrodes 6A, 6B, 6C and 6D are connected to the tooth 2*a* of the cathode electrode. A plurality of electrodes 90A, 90B, 90C and 90D are connected to the tooth 5*a* of the gate electrode. An insulating member 3 is constituted by insulating layers 3*a* and 3*b*.

(Change in Resistance Value Due to Connecting Electrode)

Figure 6A:
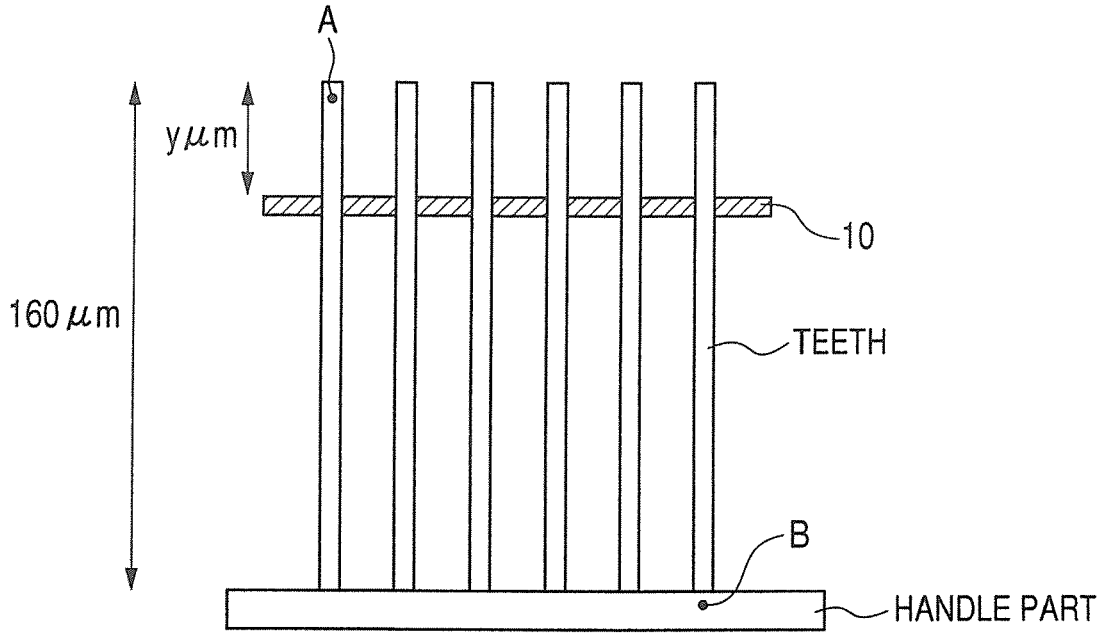
FIGS. 6A and 6B are views showing an effect of a connecting electrode according to the present invention.
Figure 6B:
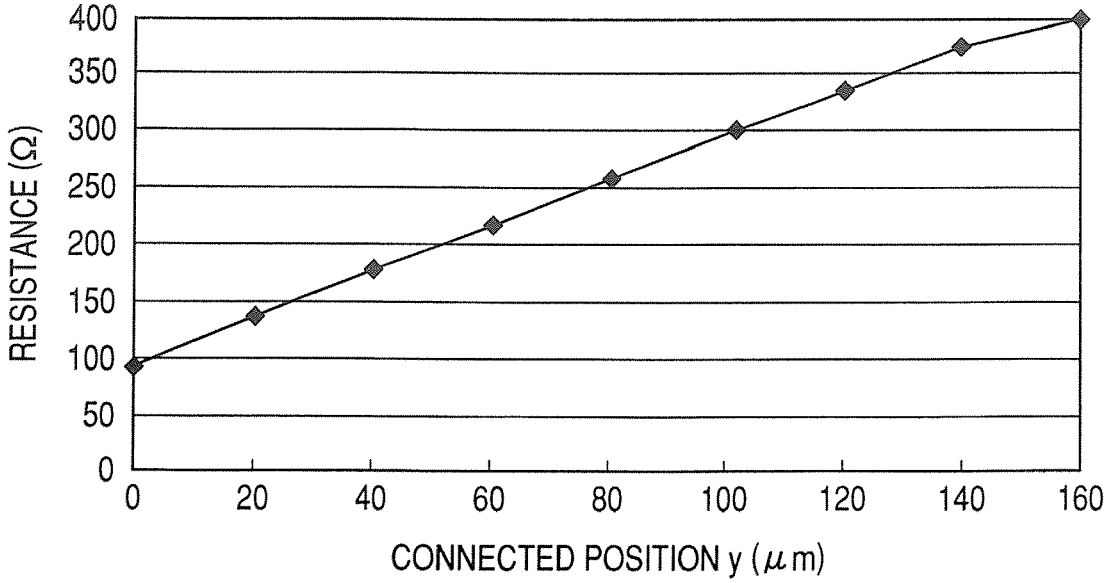

FIGS. 6A and 6B are views showing an effect of a connecting electrode 10 according to the present invention. Here, the embodiment will now be described, while taking the case where the electrodes have six lines of teeth as an example. As is illustrated in FIG. 6A, in the present embodiment, teeth were formed from Me so as to have a length of 160 μm, a width of 4 μm and a thickness of 20 nm. The connecting electrode 10 was formed of an Mo film so as to have a length of 40 μm, a width of 8 μm and a thickness of 20 nm.

FIG. 6B is a view showing a change in electric resistance in between positions A and B in the connecting electrode 10. The horizontal axis indicates a connected position y μm which is a distance between the connecting electrode 10 and the tip of the teeth. The vertical axis indicates resistance in between A and B in FIG. 6A. When the value of the horizontal axis y is 160 μm, the distance is equivalent to the case where the connecting electrode 10 does not exist. When the connecting electrode 10 was connected at the tip of the teeth (y=0 μm), the electric resistance was 93Ω. By providing the connecting electrode 10 in this way, the electric resistance of the cathode electrode can be greatly lowered in comparison with the electric resistance of 400Ω in the case of being provided with no connecting electrode. In order to sufficiently lower the resistance value, the connecting electrode 10 can be arranged in a position (y≦80 μm) closer to the end side of the teeth than the center of the teeth.

A configuration described in the present embodiment had one connecting electrode 10, but a configuration may be adopted which has a plurality of connecting electrodes with respect to a comb-like structure.

The connecting electrode 10 may be electrically connected with a gate electrode 5, as will be described in an embodiment later. The configuration may also be adopted which has a connecting electrode that is electrically connected with the gate electrode 5, aside from the connecting electrode that is electrically connected with the cathode electrode 2. However, in the case of an electron-emitting member in which an electric current flows between the cathode electrode 2 and the gate electrode 5 when potentials are applied to the cathode electrode 2 and the gate electrode 5, the electric resistance of the scan line 32 can be controlled so as to be smaller than that of the modulation line 33. When one scan line is selected, a plurality of electron-emitting devices are selected at the same time, and when an electric potential of the gate is applied to the plurality of the electron-emitting devices through the modulation line, an electric current flows into the scan line from the plurality of electron-emitting devices which have been selected at the same time. Therefore, when the electric resistance of the scan line is large, a voltage drop occurs according to a position of the scan line, and a distribution of scan potentials results in being formed in the scan line. For this reason, the electric resistance of the scan line is required to be lowered.

When an electric current caused by an electric discharge flows into an electron-emitting device through an anode electrode, this discharge current flows into a line having a smaller resistance between the scan line and the modulation line. Therefore, in the case of an electron-emitting member in which an electric current flows between the cathode electrode 2 and the gate electrode 5 when the potentials are applied to the cathode electrode 2 and the gate electrode 5, the connecting electrode 10 can be electrically connected to the cathode electrode 2.

In this way, the electric resistance of the cathode electrode can be greatly lowered by installing the connecting electrode 10. Accordingly, even when a large quantity of an electric current caused by the electric discharge flows into the scan line through the cathode electrode, the potential of the scan line can be inhibited from being raised. Thereby, the connecting electrode 10 can inhibit an excessive voltage from being applied to a plurality of electron-emitting devices that are connected to the scan line in which the discharge electric current flows, and can inhibit these electron-emitting devices from being destroyed.

Second Embodiment

Figure 7:
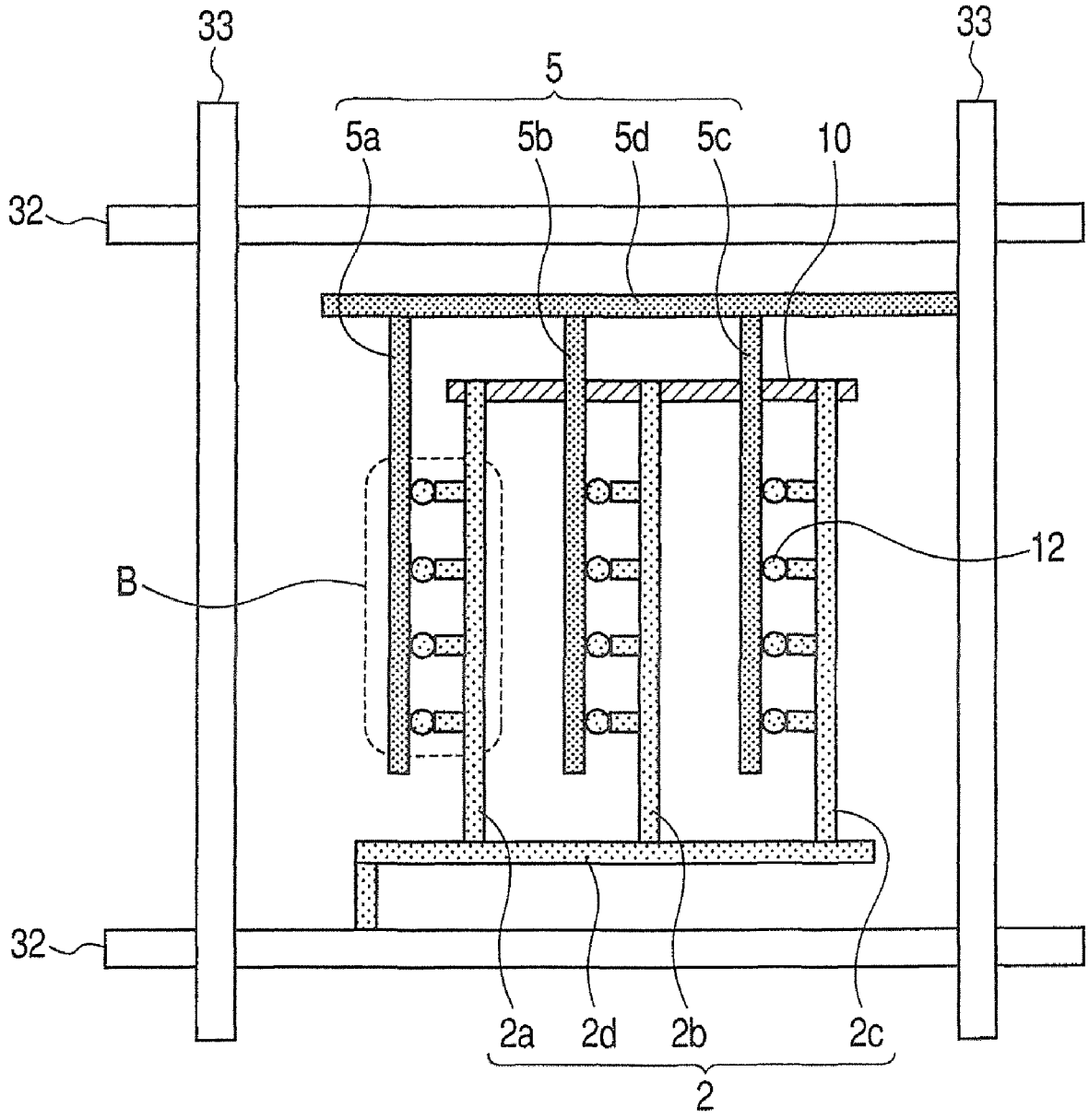
FIG. 7 is a schematic view illustrating an electron-emitting device in a second embodiment.

FIG. 7 is a schematic view illustrating an electron-emitting device in the present embodiment. The present embodiment has the same configuration as in First embodiment, except the gate electrode 5 has a different shape from that in First embodiment.

Figure 8A:
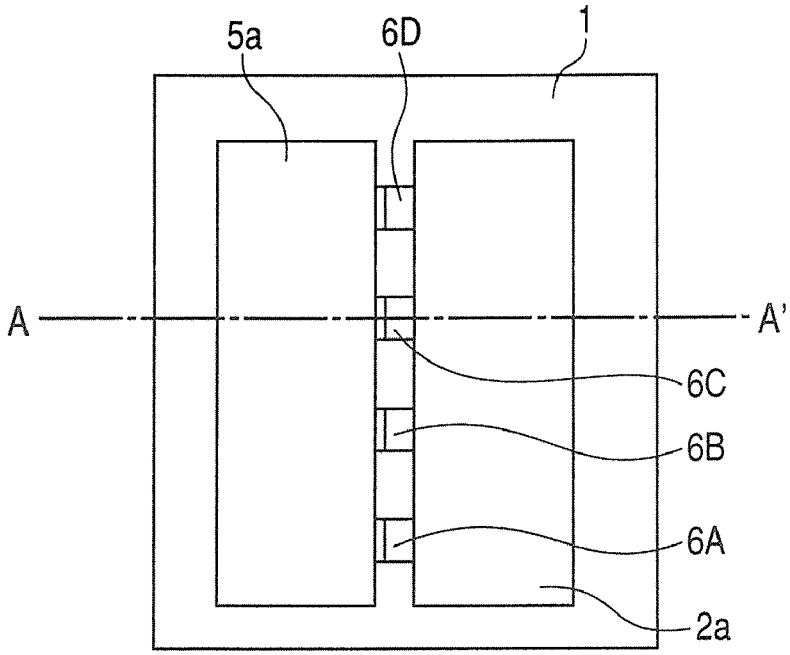
FIGS. 8A, 8B and 8C are views illustrating an electron-emitting member in the second embodiment.
Figure 8B:
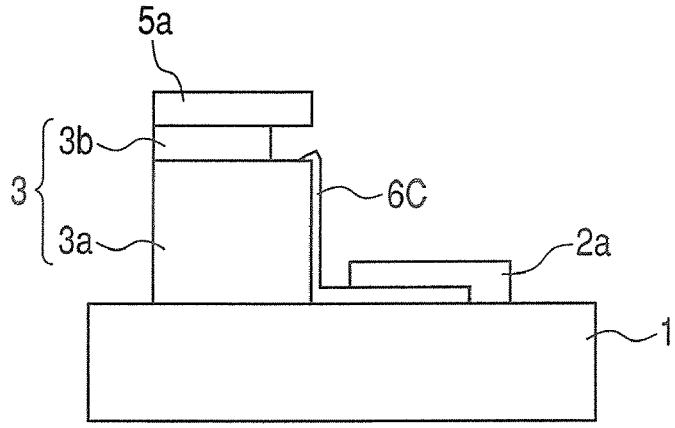
Figure 8C:
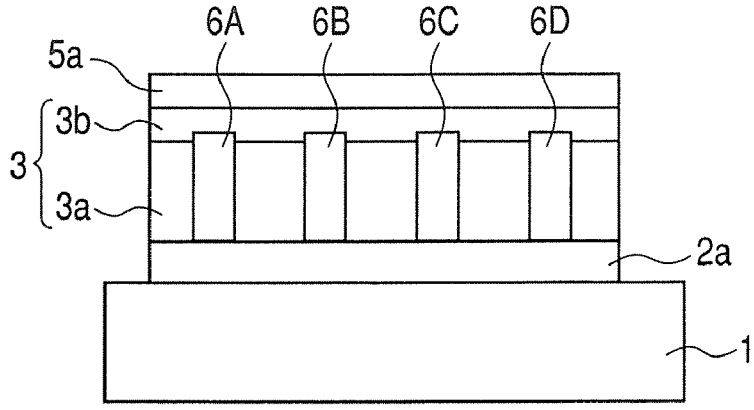

FIGS. 8A, 8B and 8C illustrate a configuration of an electron-emitting member in a portion which is shown by B in FIG. 7. FIG. 8A is a plan view of a portion which is shown by B in FIG. 7. FIG. 8B is a sectional view taken along the line A-A' of FIG. 8A. FIG. 8C is a right side view of FIG. 8A.

In First embodiment, a plurality of the electrodes 90A, 90B, 90C and 90D were connected to the tooth 5*a* of the gate electrode, but the plurality of the electrodes do not exist in the present embodiment, which is a point different from that in First embodiment. Other parts of the configuration are similar to those in First embodiment.

In the present embodiment, an electric potential of the gate and an electric potential of the cathode are applied to the tooth 5*a* of the gate electrode and a plurality of electrodes 6A, 6B, 6C and 6D respectively, and electrons are emitted from the plurality of the electron-emitting members.

The present invention can be applied to the case of employing an electron-emitting device as described in the present embodiment.

Third Embodiment

Figure 9:
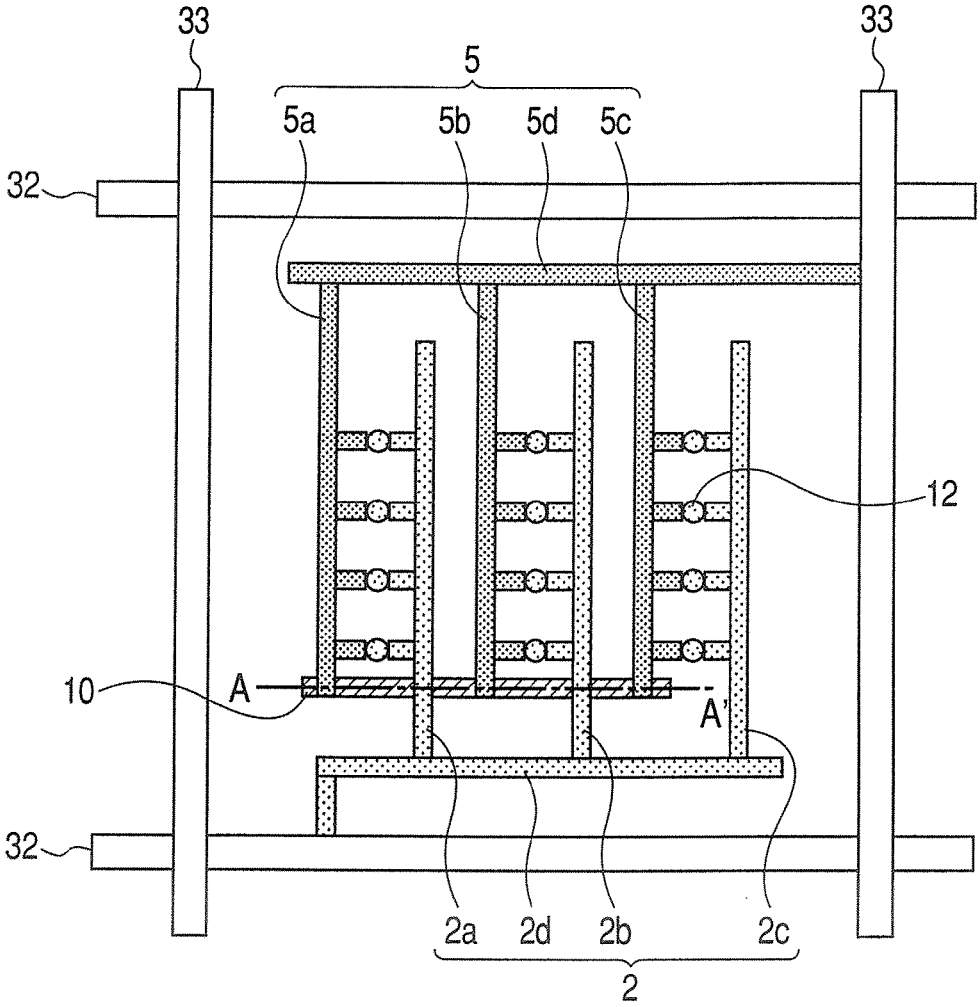
FIG. 9 is a schematic view illustrating an electron-emitting device in a third embodiment.

FIG. 9 is a schematic view illustrating an electron-emitting device in the present embodiment. In the present embodiment, a connecting electrode 10 is electrically connected to a plurality of teeth 5*a*, 5*b* and 5*c* that are included in a comb-like structure of a gate electrode 5, which is a point different from that in First embodiment. Other parts of the configuration are similar to those in First embodiment.

Figure 10:
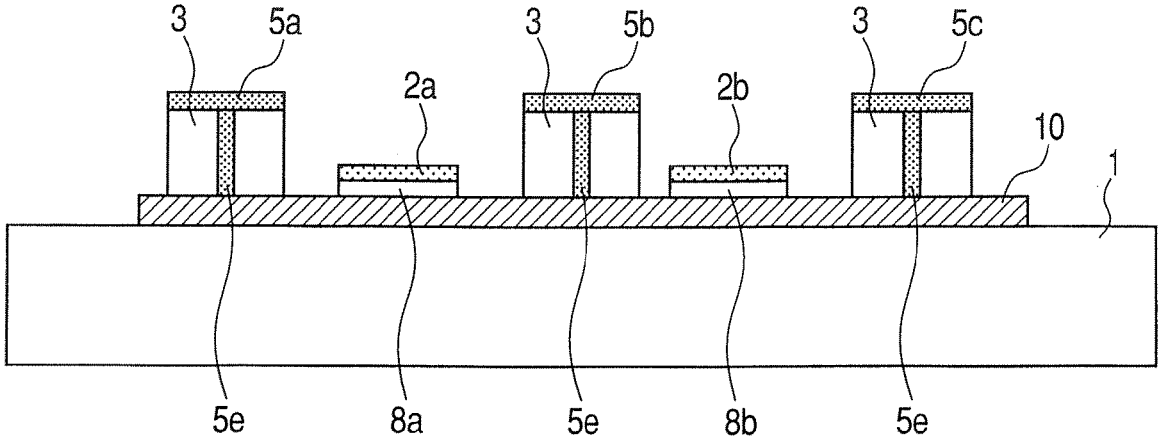
FIG. 10 is a sectional view taken along the line A-A' of FIG. 9.

FIG. 10 illustrates a sectional view taken along the line A-A' of FIG. 9.

In the present embodiment, a connecting electrode 10 is provided on a substrate 1, and teeth 2*a* and 2*b* of a cathode electrode are provided on the connecting electrode 10 through insulating layers 8*a* and 8*b*. On the other hand, an insulating member 3 is provided in between the connecting electrode 10 and the teeth 5*a*, 5*b* and 5*c* of the gate electrode. Contact holes 5*e*, 5*f* and 5*g* are provided in the insulating member 3. Thereby, the connecting electrode 10 is electrically connected only to the gate electrode 5.

In the case of an electron-emitting device in which an electric current is hard to flow between the cathode electrode 2 and the gate electrode 5 when potentials are applied to the cathode electrode 2 and the gate electrode 5, the electric resistance of a modulation line 33 can be occasionally smaller than that of a scan line 32. As described in the present embodiment, the electric resistance of the gate electrode can be greatly lowered by installing the connecting electrode 10. Accordingly, even when a large quantity of an electric current caused by the electric discharge flows into the modulation line through the gate electrode, the potential of the modulation line can be inhibited from being raised. Thereby, the connecting electrode 10 can inhibit an excessive voltage from being applied to a plurality of electron-emitting devices that are connected to the modulation line in which the discharge electric current flows, and can inhibit these electron-emitting devices from being destroyed.

Fourth Embodiment

Figure 11:
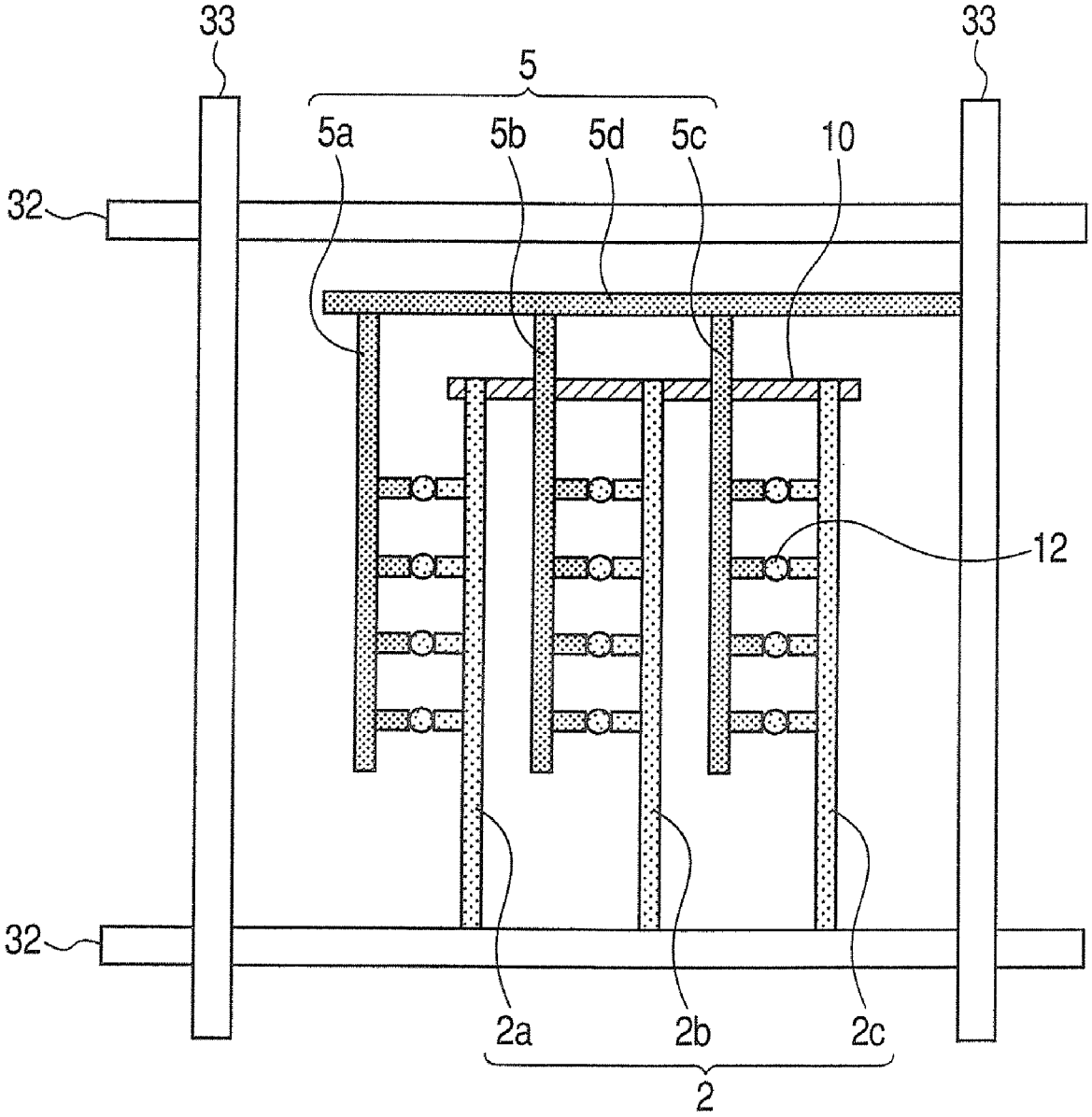
FIG. 11 is a schematic view illustrating an electron-emitting device in a fourth embodiment.

FIG. 11 is a schematic view illustrating an electron-emitting device in the present embodiment.

A cathode electrode 2 according to the present embodiment does not have a handle part 2*d*, which is a point different from that in First embodiment. Specifically, the comb-like structure of the cathode electrode 2 in the present embodiment is constituted by teeth 2*a*, 2*b* and 2*c*. The teeth 2*a*, 2*b* and 2*c* are directly connected to a scan line 32. Other parts of the configuration are similar to those in First embodiment.

In the case of the present embodiment as well, the connecting electrode 10 can inhibit an excessive voltage from being applied to a plurality of electron-emitting devices that are connected to the scan line in which the discharge electric current flows, and can inhibit these electron-emitting devices from being destroyed.

Fifth Embodiment

Figure 12:
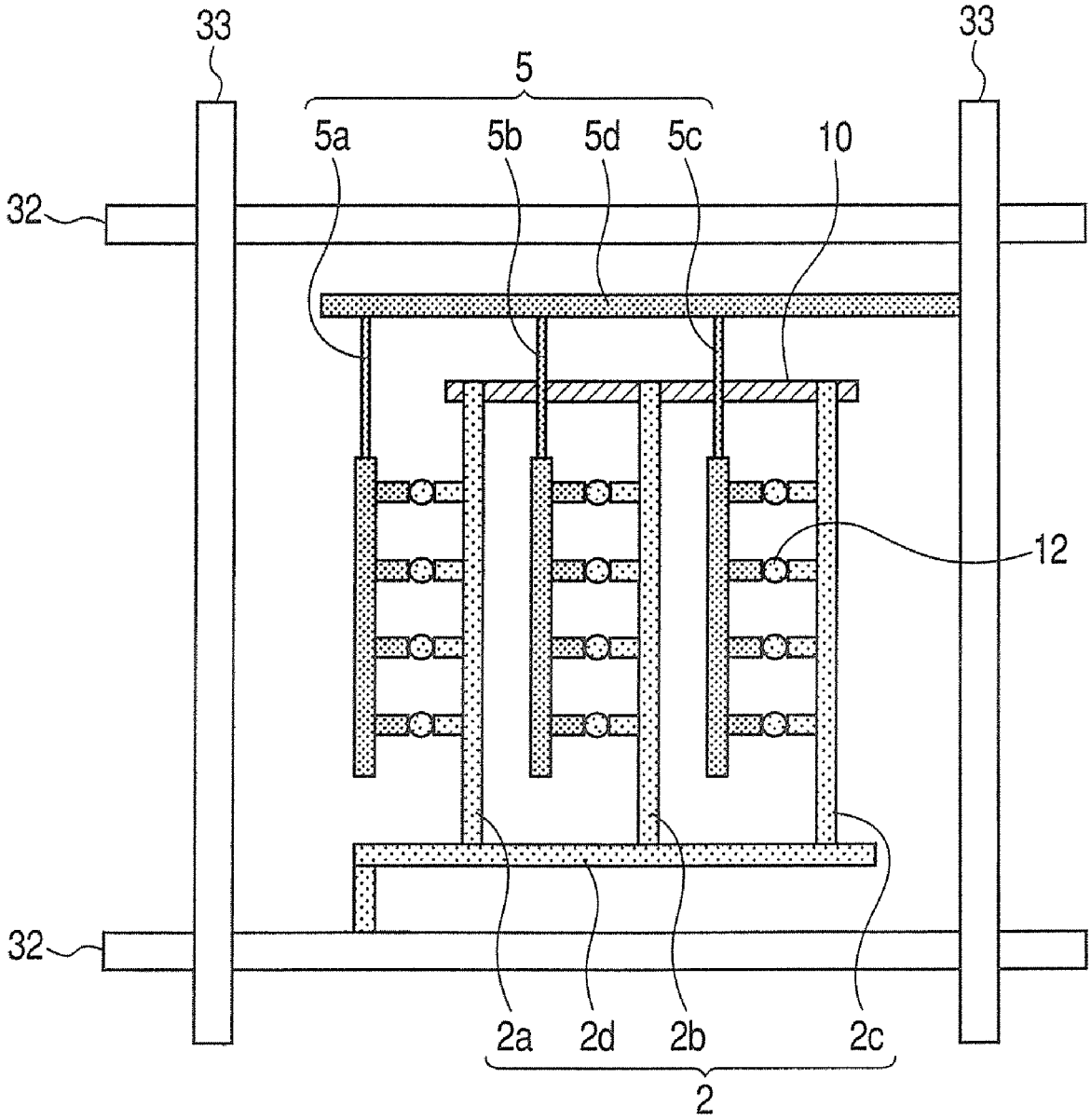
FIG. 12 is a schematic view illustrating an electron-emitting device in a fifth embodiment.

FIG. 12 is a schematic view illustrating an electron-emitting device in the present embodiment.

In the present embodiment, in teeth 5*b* and 5*c* of a gate electrode, the width of the teeth in a portion that overlaps with a connecting electrode 10 in a projection to a surface of the substrate is smaller than that in a portion that does not overlap with the connecting electrode 10, which is a point different from that in First embodiment. In the present embodiment, the width of the teeth in a portion which overlaps with the connecting electrode 10 in the projection to the surface of the substrate is set at a half of the width of the teeth in a portion which does not overlap with the connecting electrode 10. Other parts of the configuration are similar to those in First embodiment. When such a configuration is employed, the capacitance at an intersection between the connecting electrode 10 and the gate electrode 5 can be decreased. Therefore, the configuration can inhibit the electric potential of the gate to be applied to the gate electrode 5 from causing the distortion of the waveform and ringing.

The above described width of the teeth in the portion which overlaps with the connecting electrode 10 in the projection to the surface of the substrate means an average value of the widths in portions at which the connecting electrode 10 overlaps with the teeth 5*b* and 5*c* in FIG. 12. In addition, the width of the teeth in a portion which does not overlap with the connecting electrode 10 means an average value of the widths in other portions than the portions at which the connecting electrode 10 overlaps with the teeth 5*b* and 5*c*.

In addition, in the present embodiment, the tooth 5*a* does not overlap with the connecting electrode 10, so that the width of the tooth 5*a* does not necessarily need to have different widths in itself. However, when the tooth 5*a* has a different shape from those of the teeth 5*b* and 5*c*, it is considered that electric potentials of the gate to be applied to a plurality of electron-emitting members are dispersed, so that the teeth 5*a*, 5*b* and 5*c* can have the same shape.

The electron-emitting device may have a configuration in which the comb-like structure of the gate electrode 5 is stacked on the comb-like structure of a cathode electrode 2. However, when the comb-like structure of the cathode electrode 2 overlaps with the comb-like structure of the gate electrode 5 in a projection to the surface of the substrate, the capacitance due to the cathode electrode 2 and the gate electrode 5 increases.

In order to inhibit the capacitance due to the cathode electrode 2 and the gate electrode 5 from increasing, the comb-like structure of the cathode electrode 2 can be arranged in such a position as not to overlap with the comb-like structure of the gate electrode 5 in the projection to the surface of the substrate.

Furthermore, the electron-emitting device can have a configuration in which the comb-like structure of the gate electrode 5 is arranged on the comb-like structure of the cathode electrode 2, similarly to the electron-emitting device described in the above embodiments. Specifically, the comb-like structure of the gate electrode 5 can be arranged in a position farther from the substrate than the comb-like structure of the cathode electrode 2.

Sixth Embodiment

Figure 13:
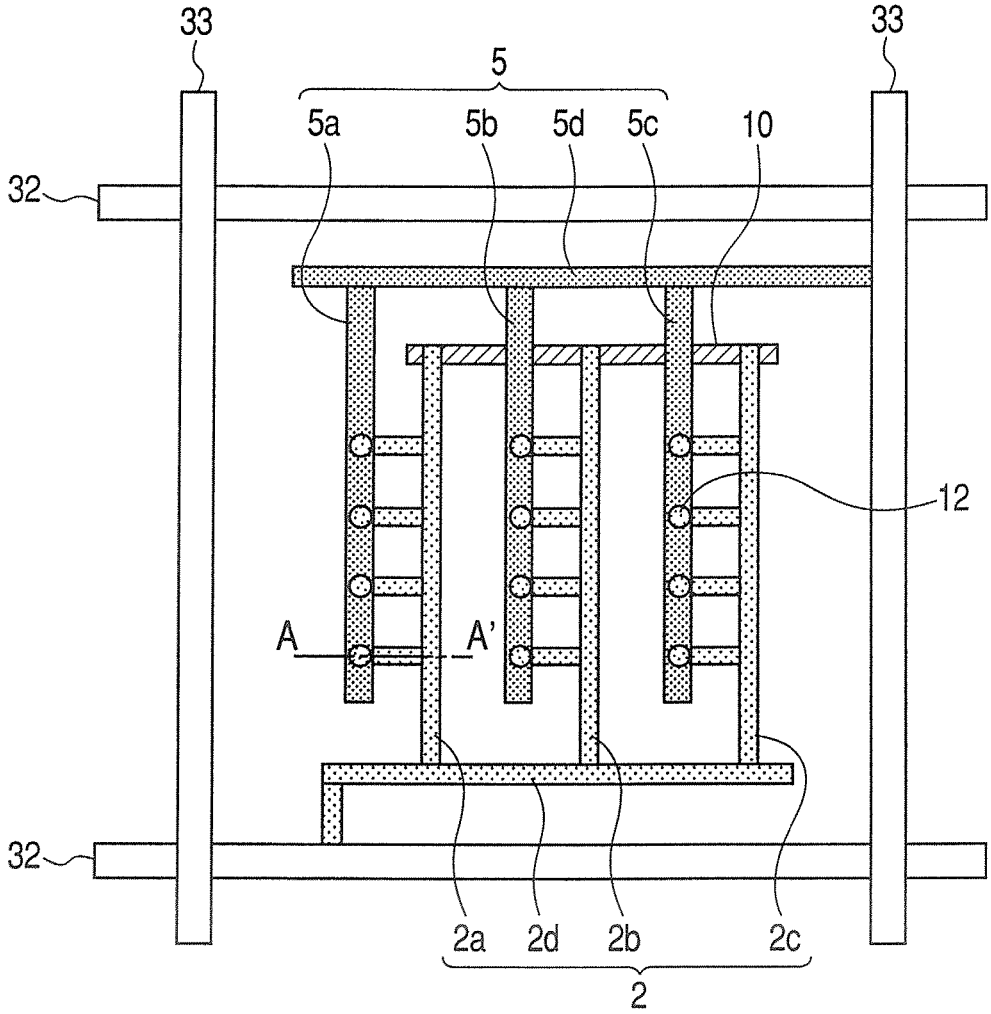
FIG. 13 is a schematic view illustrating an electron-emitting device in a sixth embodiment.
Figure 14:
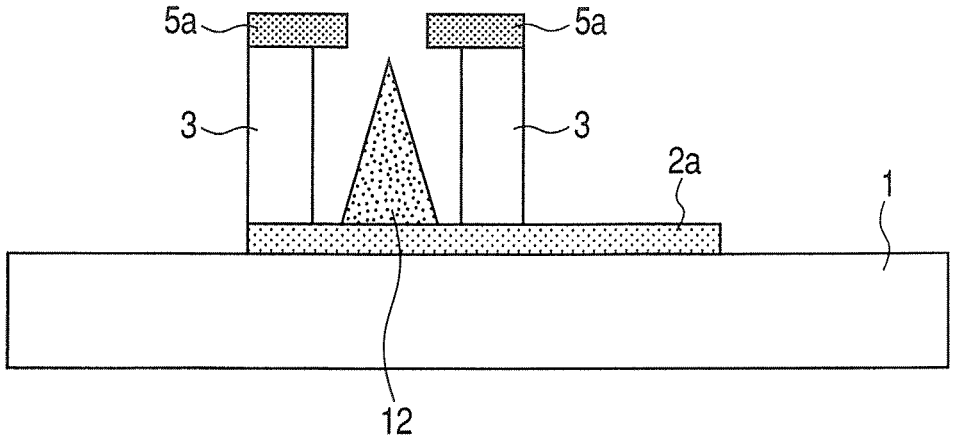
FIG. 14 is a sectional view taken along the line A-A' of FIG. 13.

FIG. 13 is a schematic view illustrating an electron-emitting device in the present embodiment. FIG. 14 illustrates a sectional view taken along the line A-A' of FIG. 13. In the present embodiment, a Spindt-type electron-emitting member 12 is used as an electron-emitting member, which is a point different from the above described embodiment. Other parts of the configuration are similar to those in the above described embodiment.

As is clear from the figure, a gate hole is provided on the tooth 5*a* of the gate electrode, through which electrons that have been emitted from the Spindt-type electron-emitting member 12 pass. The present invention can be applied to the electron-emitting device with the use of the Spindt-type electron-emitting member 12.

The present invention also can be applied to the electron-emitting device that has employed a horizontal electric-field emission type electron-emitting member in which the cathode electrode 2 and the gate electrode 5 are arranged on the same plane or a surface-conduction type electron-emitting member.

Exemplary Embodiment 1

A method for manufacturing the electron-emitting member which was described in the above First to Fifth embodiments will now be described in detail with reference to FIGS. 15A, 15B, 15C, 15D, 15E and 15F.

A substrate 1 is an insulative substrate for mechanically supporting the devices. For instance, the insulative substrate can employ a quartz glass, a glass containing a reduced amount of impurities such as Na, a blue plate glass and a silicon substrate. The substrate 1 needs to have functions of not only a high mechanical strength but also resistances to a dry etching process, a wet etching process, an alkaline solution such as a liquid developer, and an acid solution. When being used as an integrated product like a display panel, the substrate 1 can have a small difference of thermal expansion between itself and a film-forming material or another stacking member. The substrate 1 can also be a material through which an alkali element and the like hardly diffuse from the inner part of the glass due to heat treatment.

Figure 15A:
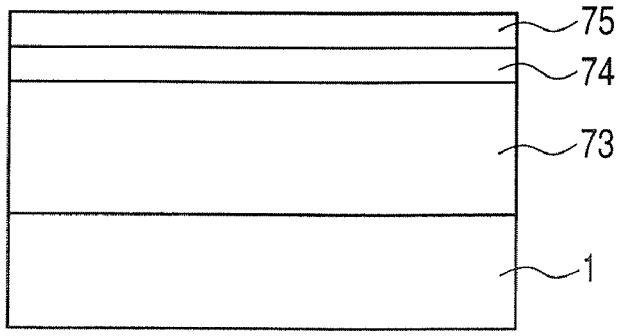
FIGS. 15A, 15B, 15C, 15D, 15E and 15F are schematic sectional views illustrating a process of manufacturing an electron-emitting member.

At first, an insulating layer 73, an insulating layer 74 and an electroconductive layer 75 are stacked on the substrate 1, as is illustrated in FIG. 15A. The insulating layers 73 and 74 are insulative films made from a material having excellent workability; are SiN (SixNy) or SiO2, for instance; and are formed with a general vacuum film-forming method such as a sputtering method, a CVD method and a vapor deposition method. Thicknesses of the insulating layers 73 and 74 are each set in a range between 5 nm and 50 μm, and can be selected from a range between 50 nm and 500 nm. Materials for the insulating layer 73 and insulating layer 74 can be selected so as to have a different etching speed from each other when being etched. A selection ratio of the insulating layer 73 to the insulating layer 74 can be 10 or more, and is 50 or more if possible. Specifically, the insulating layer 73 can employ SixNy, and the insulating layer 74 can employ an insulative material such as SiO2, a PSG film which has a high phosphorus concentration or a BSG film which has a high boron concentration, for instance.

The electroconductive layer 75 is formed with a general vacuum film-forming technology such as a vapor deposition method and a sputtering method. A material to be used for the electroconductive layer 75 can have high thermal conductivity in addition to electroconductivity and has a high melting point. The material includes, for instance: a metal such as Be, Mg, Ti, Zr, Hf, V, Nb, Ta, Mo, W, Al, Cu, Ni, Cr, Au, Pt and Pd, or an alloy material thereof; and a carbide such as TiC, ZrC, HfC, TaC, SiC and WC. The material also includes: a boride such as HfB2, ZrB2, CeB6, YB4 and GdB4; a nitride such as TiN, ZrN, HfN and TaN; a semiconductor such as Si and Ge; and an organic polymer material. The material further includes amorphous carbon, graphite, diamond like carbon, carbon having diamond dispersed therein, and a carbon compound. The material is appropriately selected from the above materials.

The thickness of the electroconductive layer 75 is set in a range of 5 nm to 500 nm, and can be selected from the range of 50 nm to 500 nm.

Figure 15B:
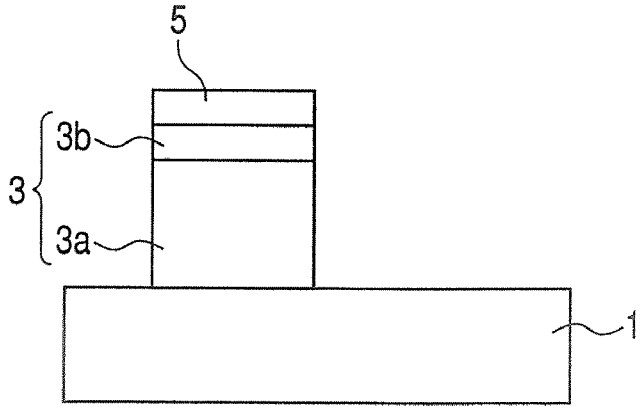

Subsequently after the above layers have been stacked, a resist pattern is formed on the electroconductive layer 75 with a photolithographic technology, and then the electroconductive layer 75, the insulating layer 74 and the insulating layer 73 are sequentially processed with an etching technique, as is illustrated in FIG. 15B. Thereby, a gate electrode 5 and an insulating member 3 formed of an insulating layer 3*b* and an insulating layer 3*a* can be obtained.

A method to be generally employed for such an etching process is an RIE (Reactive Ion Etching) which can precisely etch a material by irradiating the material with a plasma that has been formed through the conversion of an etching gas. A processing gas to be selected at this time is a fluorine-based gas such as CF4, CHF3 and SF6, when an objective member to be processed forms a fluoride. When the objective member forms a chloride as Si and Al do, a chloride-based gas such as C12 and BC13 is selected. In order to impart a selection ratio to the above layers with respect to a resist, to surely acquire the smoothness of an etched face, or to increase an etching speed, gaseous hydrogen, oxygen, argon or the like is added whenever necessary.

Figure 15C:
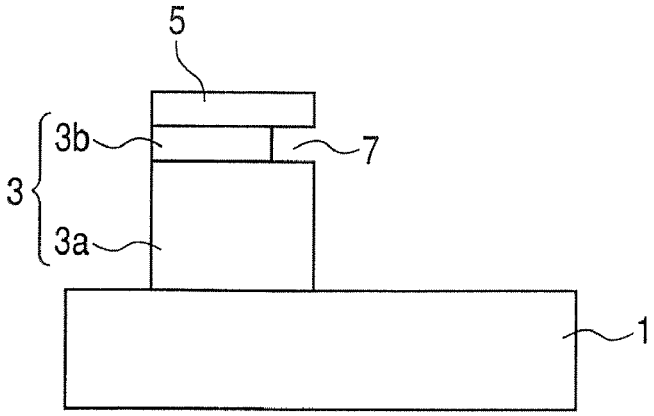

Subsequently, only a side face of the insulating layer 3*b* is partially removed on one side face of the stacked body by using an etching technique, and a recess portion 7 is formed as is illustrated in FIG. 15C.

A mixture solution of ammonium fluoride and hydrofluoric acid, which is referred to as a buffer hydrofluoric acid (BHF), can be used for the etching technique when the insulating layer 3*b* is a material formed from SiO2, for instance. When the insulating layer 3*b* is a material formed from SixNy, the insulating layer 3*b* can be etched with the use of a phosphoric-acid-based hot etching solution.

The depth of the recess portion 7 is specifically a distance between the side face of the insulating layer 3*b* and the side faces of the insulating layer 3*a* and the gate 5, in the recess portion 7; and can be formed so as to be approximately 30 nm to 200 nm.

Incidentally, the present embodiment showed a form in which the insulating member 3 is a stacked body of the insulating layer 3*a* and the insulating layer 3*b*, but the present invention is not limited to the form. The recess portion 7 may be formed by removing a part of one insulating layer.

Figure 15D:
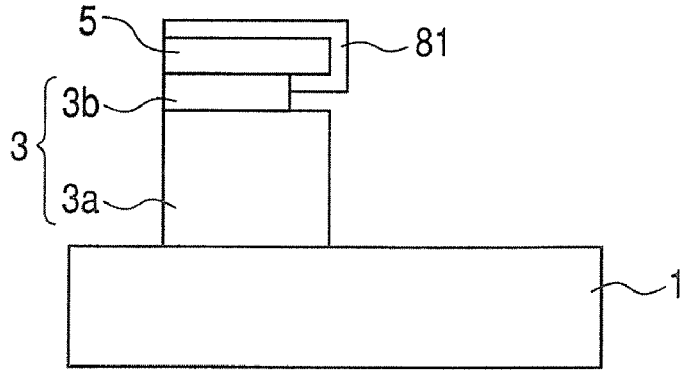

Subsequently, a release layer 81 is formed on the surface of the gate electrode 5, as is illustrated in FIG. 15D. The release layer is formed for the purpose of separating a cathode material 82 which will deposit on the gate electrode 5 in the next step, from the gate electrode 5. For such a purpose, the release layer 81 is formed, for instance, by forming an oxide film on the gate electrode 5 through oxidization or by depositing a release metal with an electrolytic plating method.

Figure 15E:
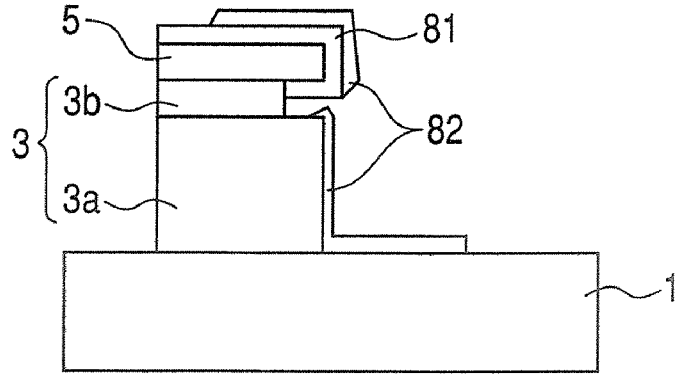

The cathode material 82 is deposited on the substrate 1 and the side face of the insulating member 3, as is illustrated in FIG. 15E. At this time, the cathode material 82 deposits on the gate 5 as well.

The cathode material 82 may be a material which has electroconductivity and emits an electric field, and generally can be a material which has a high melting point of 2,000° C. or higher, has a work function of 5 eV or less, and hardly forms a chemical reaction layer thereon such as an oxide or can easily remove the reaction layer therefrom. Such materials include: a metal such as Hf, V, Nb, Ta, Me, W, Au, Pt and Pd or an alloy material thereof; a carbide such as TiC, ZrC, HfC, TaC, SiC and WC; and a boride such as HfB2, ZrB2, CeB6, YB4 and GdB4. Such materials also include: a nitride such as TiN, ZrN, HfN and TaN; and amorphous carbon, graphite, diamond like carbon, carbon having diamond dispersed therein and a carbon compound.

A method to be employed for depositing the cathode material 82 is a general vacuum film-forming technology such as a vapor deposition method and a sputtering method, and can be an EB vapor deposition method.

Figure 15F:
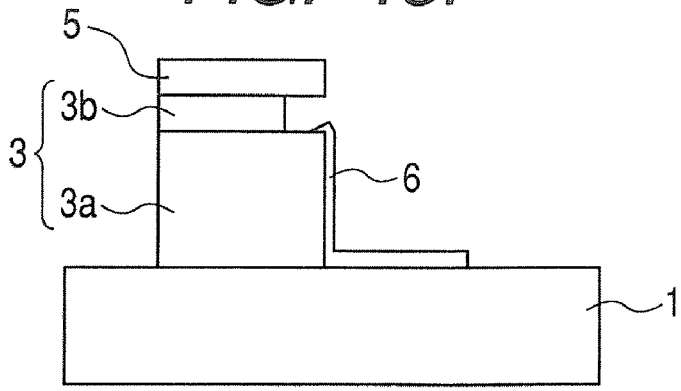

Subsequently, the cathode material 82 on the gate electrode 5 is removed by removing the release layer 81 with an etching technique, as is illustrated in FIG. 15F. In addition, electrodes 6 (6A to 6D) are formed by patterning the cathode material 82 on the substrate 1 and on the side face of the insulating member 3 with a photolithography.

Next, the cathode electrode 2 is formed so as to force the electrode 6 into electric conduction (FIG. 8B). This cathode electrode 2 has electroconductivity similarly to the electrode 6, and is formed with a general film-forming technology such as a vapor deposition method and a sputtering method, and with a photolithographic technology. Materials for the electrode 2 include, for instance: a metal such as Be, Mg, Ti, Zr, Hf, V, Nb, Ta, Me, W, Al, Cu, Ni, Cr, Au, Pt and Pd, or an alloy material thereof; and a carbide such as TiC, ZrC, HfC, TaC, SiC and WC. The materials also include: a boride such as HfB2, ZrB2, CeB6, YB4 and GdB4; a nitride such as TiN, ZrN and HfN; a semiconductor such as Si and Ge; and an organic polymer material. The materials further include amorphous carbon, graphite, diamond like carbon, carbon having diamond dispersed therein, and a carbon compound. The material is appropriately selected from the above materials.

The cathode electrode 2 and the gate electrode 5 may be made from the same material or different materials, and may be formed with the same forming method or different methods.

In order to form an electron-emitting member in FIGS. 5A, 5B and 5C which was described in First embodiment, a preparation step of the release layer 81 in FIG. 15D is omitted, and the cathode material 82 is directly deposited on the gate electrode 5 as well. Then, in the step of FIG. 15F, the cathode material 82 on the substrate 1 and the side face of the insulating member 3 may be patterned to form the electrode 6, and simultaneously the cathode material 82 on the gate electrode 5 may be patterned to form electrodes 90 (90A to 90D).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-120409, filed May 2, 2008, which is hereby incorporated by reference herein in its entirety.

What is claimed is:

1. An electron source comprising:

a matrix wiring configuration including a plurality of column wirings, and a plurality of row wirings, wherein a cathode electrode is connected to one of the column wirings, and is divided into a plurality of comb-teeth like cathode electrodes, a gate electrode is connected to one of the row wirings, and is divided into a plurality of comb-teeth like gate electrodes, and an electron-emitting member is arranged between a corresponding one of the comb-teeth like cathode electrodes and a corresponding one of the comb-teeth like gate electrodes, and wherein a connecting electrode is electrically connected to at least one of the comb-teeth like cathode electrodes and comb-teeth like gate electrodes.

2. The electron source according to claim 1, wherein said connecting electrode is electrically connected to an end of the at least one of the comb-teeth like cathode electrodes and comb-teeth like gate electrodes.

3. The electron source according to claim 1, wherein said connecting electrode makes mutual electrical connections among the plurality of the comb-teeth like cathode electrodes.

4. The electron source according to claim 3, wherein a width of part of at least one of the comb-teeth like gate electrodes which overlaps with said connection electrode in a projection to a surface of the substrate is narrower than a width of part of at least one of the comb-teeth like gate electrodes which does not overlap with said connecting electrode in the projection to the surface of substrate.

5. The electron source according to claim 1, wherein the corresponding one of the comb-teeth like gate electrodes is disposed above the corresponding one of the comb-teeth like cathode electrodes.

6. The electron source according to claim 1, wherein the comb-teeth like cathode electrodes are disposed not to overlap with the comb-teeth like gate electrodes in a projection to a surface of the substrate.

7. Image display apparatus provided with the electron source according to claim 1.

8. The electron source according to claim 1, wherein a sub-pixel unit is corresponding to a group of the electron-emitting members which are electrically connected to one of the plurality of column wirings and to one of the plurality of row wirings, the connecting electrode is electrically connected to at least one of the comb-teeth like cathode electrodes and comb-teeth like gate electrodes in the sub-pixel unit.

* * * * *